United States Patent [19]

Basiulis

[11] 4,033,406

[45] July 5, 1977

[54] HEAT EXCHANGER UTILIZING HEAT PIPES

[75] Inventor: Algred Basiulis, Redondo Beach, Calif.

[73] Assignee: Hughes Aircraft Company, Culver City, Calif.

[22] Filed: July 21, 1976

[21] Appl. No.: 707,410

Related U.S. Application Data

[63] Continuation of Ser. No. 502,594, Sept. 3, 1974, abandoned.

[52] U.S. Cl. ..... 165/32; 165/105; 165/110; 165/DIG. 1

[51] Int. Cl.[2] ..... F28B 1/06; F28D 15/00

[58] Field of Search ..... 165/32, 96, 105, 110, 165/DIG. 1

[56] References Cited

UNITED STATES PATENTS

| | | | |
|---|---|---|---|
| 3,347,309 | 10/1967 | Webb | 165/105 X |
| 3,516,487 | 6/1970 | Keiser | 165/105 |
| 3,572,426 | 3/1971 | Edwards | 165/105 X |
| 3,613,773 | 10/1971 | Hall et al. | 165/32 |
| 3,788,388 | 1/1974 | Barkmann | 165/32 |

*Primary Examiner*—Albert W. Davis, Jr.
*Attorney, Agent, or Firm*—Lewis B. Sternfels; W. H. MacAllister

[57] ABSTRACT

The heat exchanger utilizes variable conductance heat pipes to control the temperature of a cooled liquid or condensate, such as in dry cooling towers, chemical processes, air conditioning, and pollution control. Heat pipes, connected to common or separate gas reservoirs, extend between two separate ducts, one of which is for flow of air and the other is for cooling or condensation of a fluid. The fluid gives up heat to the heat pipes and cooled fluid is collected thereafter. In the air duct, heat is removed from the heat pipes, with the gas reservoir controlling the temperature of the heat pipes, as well as maintaining a constant temperature in the cooling side of the heat exchanger to control the cooling process, to maintain the gas front of the working fluid in the heat pipe solely within the air flow chamber, and to prevent solidification of fluids in the cooling side of the heat exchanger.

10 Claims, 5 Drawing Figures

HEAT EXCHANGER UTILIZING HEAT PIPES

This is a continuation of application Ser. No. 502,594, filed Sept. 3, 1974, now abandoned.

BACKGROUND OF THE INVENTION

1. Field of the Invention

The present invention relates to a heat exchanger for dry cooling towers, air and fluid coolers, condensers, pollution control, air conditioning, chemical processing, and the like, and, in particular, to such a heat exchanger utilizing heat pipes with attached gas reservoir in which solidification of a fluid to be cooled or processed is prevented.

2. Description of the Prior Art

Heat exchangers for dry cooling towers or air coolers, such as used by the oil industry, have two basic problems, to wit, temperature control of the cooling pipes, and prevention of liquid freeze-up or solidification due to change in air temperature. To compensate for these problems, elaborate and expensive controls are utilized. For example, in water cooling applications, water freeze-up results from a change in cooling temperature with a consequent possible damage of equipment, as a result of the condition when cooling air temperature falls below freezing. In chemical process and pollution control applications, impurities and pollutants must be condensed from the vapor or liquid. In general, the prior art utilizes cross-flow heat exchangers in which air flows over a bank of pipes cooling the pipes. To be cooled, liquid or vapor flows in the pipes counter to the air flow. When the air temperature changes, gases, liquids or other fluids in the pipes may freeze or solids may precipitate out thereby fouling or completely clogging the system. To prevent these problems, elaborate designs and controls are used.

SUMMARY OF THE INVENTION

The present invention overcomes these and other problems by utilizing heat pipes placed between a pair of chambers or ducts. The fluid to be cooled flows through a first duct while the cooling fluid passes through the second duct. Heat from the fluid to be cooled in the first duct passes into the heat pipes and is withdrawn in the cooling fluid second duct. A gas reservoir system at the end of the heat pipes at the second duct controls the temperature of the heat pipes, maintains a constant pressure and temperature and prevents solidification or freeze-up of fluids in the first duct of the heat exchanger, and maintains the gas front of the working fluid in the heat pipes within that portion of the heat pipes residing within the second duct.

It is, therefore, an object of the invention to provide a means for maintaining a preset temperature for cooling of fluid regardless of varying atmospheric temperatures.

Another object is to provide means for eliminating possible solidification of fluids in chemical process applications.

Another object is to provide means for condensing pollutants out of fluids at a preset temperature.

Another object is to provide means for preventing freezing of fluids subjected to exterior temperature drop.

Other aims and objects as well as a more complete understanding of the present invention will appear from the following explanation of exemplary embodiments and the accompanying drawings thereof.

DESCRIPTION OF THE PREFERRED EMBODIMENTS

Figure 1:
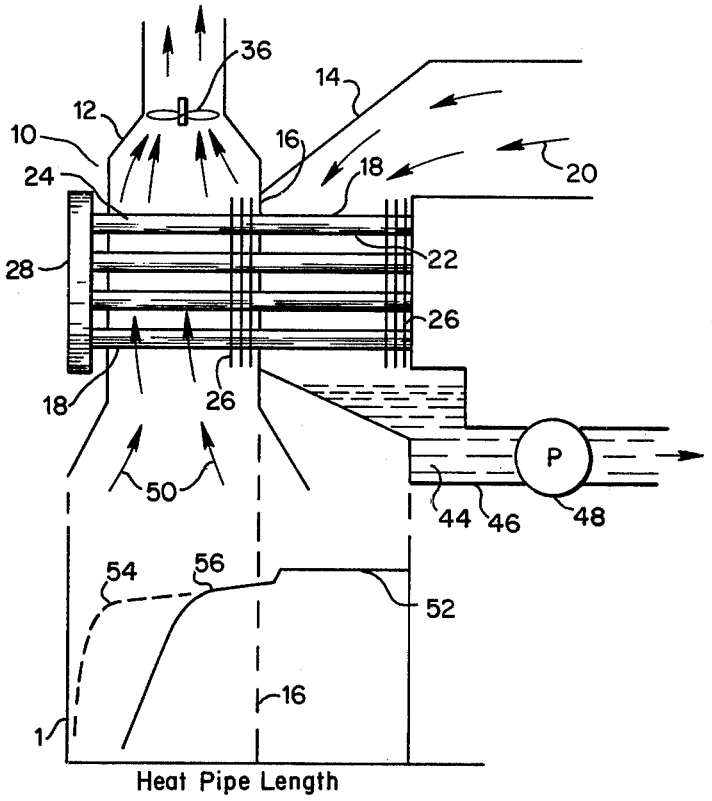
FIG. 1 illustrates a first embodiment of the present invention utilizing a gas reservoir common to the heat pipes with a diagram of changing temperature conditions therefore showing movement of the gas front of the working fluid.
Figure 2:
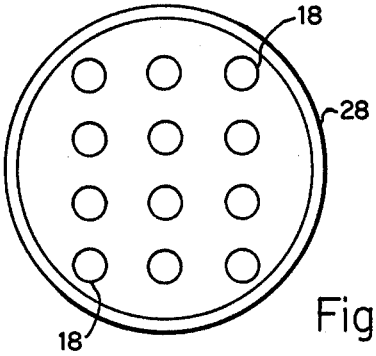
FIG. 2 is an end view of the heat pipe and reservoir arrangement shown in FIG. 1.

Referring to FIG. 1, a heat exchanger 10 comprises an air or fluid cooling chamber 12, a chamber or duct 14 for reception of a liquid, gas or other fluid, identified by arrows 20, to be cooled or condensed, and a partitioning wall 16 separating chambers 12 and 14. Chambers 12 and 14 are sometimes referred to herein respectively as second and first ducts. Placed through partition wall 16 is a plurality of variable conductance heat pipes 18 for controlling the temperature of fluid 20 in chamber or first duct 14. A fan 36 in chamber or second duct 12 may be used to control air flow.

Figure 3:
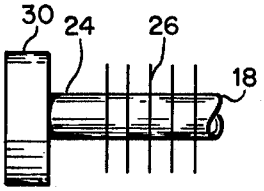
FIG. 3 depicts a modification of the invention depicted in FIG. 1 utilizing single gas reservoirs for each of the heat pipes.
Figure 4:
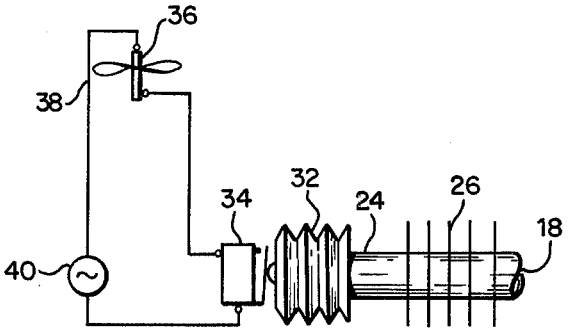
FIG. 4 depicts a further modification of the present invention utilizing a bellows type reservoir with a microswitch used to control fan speed in the cooling chamber.

As is conventional in the art, heat pipes 18 have a first section 22 for evaporation of the working fluid therein and an end 24 for condensation of the working fluid. Fins 26 may be provided on the heat pipe at one or more points to enhance heat transfer. At ends 24 of the heat pipes is a gas reservoir 28 which as shown in FIG. 1, is secured to all the heat pipes, but the reservoir may comprise individual gas reservoirs 30 as shown in FIG. 3. These reservoirs may be an excess volume type or, as shown in FIG. 4, a bellows type, employing a bellows 32. Furthermore, bellows 32 may be used to actuate a microswitch or a mechanical actuator 34 which, in turn, controls the speed of fan 36 in chamber 12 for movement of the air and control of its rate of flow. Circuitry 38 including a source of power 40 connects the fan and the microswitch in series.

Figure 5:
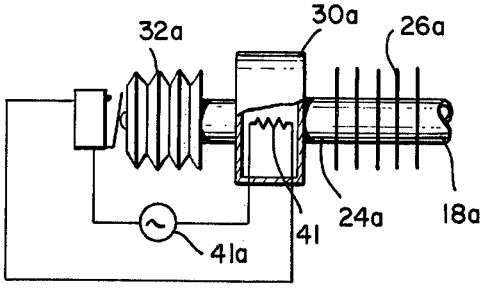
FIG. 5 illustrates another modification where excellent control is required.

At times, the temperature in gas reservoir 30 can change, resulting in a drop of gas pressure and, consequently, the boiling point of the working fluid and control point. Although the amount of change is minute, in some applications such change is not permissible. Therefore, as shown in FIG. 5, for added control a heater 41 is placed within a reservoir **30*a* and coupled to a bellows 32*a* which, in turn, is coupled to a microswitch. If desired however, the heater may be placed directly within the bellows 32 of FIG. 4, and coupled to a source of power 41*a*, which may, if desired, be the same as source 40. Heater 41 is actuated to maintain a constant temperature and, therefore, a constant gas pressure within heat pipe 18**.

In operation, such as in a dry cooling tower, liquid or vapor 20 to be cooled is introduced at inlet 42 of first chamber 14. As the liquid or vapor flows through chamber 14, it passes by and over heat pipes 18, giving up heat to the pipes and cooling the liquid or vapor, for example, as a condensate, as depicted by indicium 44, which is collected at an outlet 46 of chamber 14. The cooled liquid may be then pumped back into the system to continue the process such as by a pump 48.

In second chamber 12, air, such as depicted by arrows 50, flows upwardly past heat pipe ends 24, thereby removing heat therefrom. Gas reservoir 28 controls the temperature of the heat pipes so as to maintain a constant temperature on the cooling side of the heat exchanger within chamber 14.

As shown in the graph of FIG. 1, it is desired to keep the temperature at end 22 at a constant temperature such as depicted by flat portion 52 of the curve shown therein. Depending upon the temperature of air 50 and its rate of cooling the heat pipes, the gas front of the working fluid within heat pipes ends 24 will move back and forth therein. During the day, for example, when exterior air is relatively high, the gas front extends far to the left as shown at point 54 of the curve. At night, however, when the air temperature may drop even to below freezing, the gas front in heat pipe ends 24 moves towards duct 14 to a point 56 of the curve. In any case, the heat pipes, with gas reservoirs and, if needed, switching mechanisms operated by bellows 32 amd 32*a*, are so constructed as to have an operating temperature range which will maintain the gas front of the working fluid only within that portion of the heat pipes which are within second chamber 12 so as to maintain the temperature within chamber 14 at equilibrium.

This operation is particularly important in water cooling applications so as to prevent water freeze-up due to change of cooling air temperature, and possible damage to equipment. This condition develops particularly when the cooling air temperature drops below freezing where the gas front of the working fluid in the heat pipe extending in second duct or chamber 12 will move to the right reducing the effective condenser area of the heat pipe compensating for increased cooling load. However, the evaporator end 22 within first chamber 14 remains at the present temperature because the heat loads are at equilibrium.

In chemical process applications, heat pipes 16 can be used to condense impurities and, in addition, to remain above the pour point of the liquid to eliminate possible solidification of fluid. In pollution control applications, heat pipes 18 can be used to condense out pollutants at a preset temperature.

Although the invention has been described with reference to particular embodiments thereof, it should be realized that various changes and modifications may be made therein without departing from the spirit and scope of the invention.

What is claimed is:

1. A dry cooling tower using ambient atmosphere as a cooling medium comprising:

first and second ducts having a wall therebetween for partitioning said first duct from said second duct;

said first duct having means for defining an inlet for receiving a fluid at a first temperature and having means for defining an outlet for collecting the fluid at a second temperature lower than the first temperature;

said second duct having means for conveying the cooling medium therethrough, within a range of specified temperatures lower than the second temperature existing in said first duct; and a plurality of heat pipes with a working fluid and an inert gas therein extending through said partitioning wall and within both said ducts, each of said heat pipes having a first end in said first duct and a second end in said second duct and a gas front between the working fluid and the inert gas, said first end having means contactable with the fluid in said first duct for evaporating said working fluid into a vapor within the range of the specified temperatures and said second end having means for condensing said working fluid at a preset temperature between the first and second temperatures, said heat pipes having an operative temperative range and including means at said second end responsive to the vapor and the cooling medium for maintaining the position of the gas front between said working fluid and the inert gas only within said second end regardless of the temperature within the range of specified temperatures, for maintaining the preset temperature, and for preventing solidification of the fluids in said first duct even when the temperature of the ambient atmosphere falls below the solidification temperature of the fluids in said first duct.

2. A dry cooling tower as in claim 1 further including a reservoir for the inert gas operatively secured to all said heat pipes at said second end thereof.

3. A dry cooling tower as in claim 2 further including means for defining a heater within said gas reservoir for maintaining the temperature thereof constant.

4. A dry cooling tower as in claim 1 further including separate reservoirs for the inert gas operatively secured to each of said heat pipes at said second end thereof.

5. A dry cooling tower as in claim 4 wherein each of said gas reservoirs includes a bellows, and further including means connected to said bellows and operated thereby for actively controlling the temperature of said heat pipes at said second end thereof and for preventing the gas front from exisiting outside of said second end.

6. A dry cooling tower as in claim 5 wherein said bellows connected means includes a heater within said gas reservoirs for maintaining the temperature thereof constant.

7. A dry cooling tower using ambient atmosphere as a cooling medium comprising:

first and second chambers;

means for conveying the cooling medium through said second chamber; and at least one heat pipe having portions extending between said chambers and including means in said second chamber and responsive to temperatures therein for maintaining a preset temperature in said heat pipe portion is said first chamber and for preventing solidification of a fluid to be cooled in said first chamber during temperature changes within a range of temperatures in said second chamber even when the temperature of the cooling medium falls below the temperature at which said fluid to be cooled solidifies.

8. A dry cooling tower as in claim 7 wherein said heat pipes include a working fluid, means in said first chamber contactable with said fluid to be cooled for evaporating said working fluid at the preset temperature, and means in said second chamber for condensing said working fluid within the range of temperatures, and wherein said maintaining means includes an inert gas which establishes a gas front at said working fluid only within said second chamber.

9. A dry cooling tower as in claim 8 wherein said maintaining means further includes at least one reservoir secured to said heat pipes and reservoir for maintaining the temperature of said reservoir substantially constant and thereby for maintaining the gas pressure in said heat pipes and the boiling point of said working fluid substantially constant.

10. A heat exchanger for dry cooling towers, air and fluid coolers, condensers, pollution control, air conditioning, chemical processing, and the like comprising:

first and second ducts having a wall for partitioning said first duct from said second duct;

said first duct having means for defining an inlet for receiving a fluid at a first temperature and having means for defining an outlet for collecting the fluid at a second temperature lower than the first temperature;

said second duct having means for transferring a cooling fluid therethrough, within a range of specified temperatures lower than the second temperatures;

means for defining a plurality of heat pipes with a working fluid therein, and extending through said partitioning wall and within both said ducts, each of said heat pipe means having a first end in said first duct having means for evaporating said working fluid within the range of the specified temperatures and second ends in said second duct having means for condensing said working fluid at a preset temperature between the first and second temperatures, said heat pipes means having an operative temperative range for providing and maintaining a gas front of said working fluid only within said second end regardless of the temperature within the range of specified temperatures and thereby for maintaining the preset temperature;

gas reservoirs, each including a bellows, operatively secured to each of said heat pipe means at said second ends thereof;

means for defining a fan in said second duct for transferring of the cooling fluid therethrough; and means for defining an electric switch coupled to said bellows and an electric circuit for coupling said fan and said electric switch in series for thereby controlling the speed and operation of said fan and the rate of said transferring of the cooling fluid through said second duct.

* * * * *